US010569595B2

(12) United States Patent
Kurita

(10) Patent No.: US 10,569,595 B2
(45) Date of Patent: Feb. 25, 2020

(54) DIRECT LIQUID TYPE OF WRITING TOOL

(71) Applicant: KABUSHIKI KAISHA PILOT CORPORATION, Chuo-Ku, Tokyo (JP)

(72) Inventor: Tetsuhiro Kurita, Aichi (JP)

(73) Assignee: KABUSHIKI KAISHA PILOT CORPORATION, Tokyo (JP)

( * ) Notice: Subject to any disclaimer, the term of this patent is extended or adjusted under 35 U.S.C. 154(b) by 48 days.

(21) Appl. No.: 15/738,147

(22) PCT Filed: Jun. 13, 2016

(86) PCT No.: PCT/JP2016/067528
§ 371 (c)(1),
(2) Date: Dec. 20, 2017

(87) PCT Pub. No.: WO2016/208436
PCT Pub. Date: Dec. 29, 2016

(65) Prior Publication Data

US 2018/0186172 A1 Jul. 5, 2018

(30) Foreign Application Priority Data

Jun. 26, 2015 (JP) ..... 2015-129296

(51) Int. Cl.
*B43K 5/18* (2006.01)
*B43K 8/04* (2006.01)

(52) U.S. Cl.
CPC . *B43K 5/18* (2013.01); *B43K 8/04* (2013.01)

(58) Field of Classification Search
CPC . B43K 5/18; B43K 8/04; B43K 1/003; B43K 1/006; B43K 1/12; B43K 1/01;
(Continued)

(56) References Cited

U.S. PATENT DOCUMENTS 6,086,279 A * 7/2000 Yen ..... B43K 23/08 401/198
7,073,967 B2 * 7/2006 Choi ..... B43K 8/04 401/198

(Continued)

FOREIGN PATENT DOCUMENTS

EP 1 832 442 A1 9/2007 ..... B43K 7/10
JP A-2006-212884 8/2006 ..... B43K 8/02
JP 2008-23755 A 2/2008 ..... B41J 29/38

OTHER PUBLICATIONS

European Search Report dated Feb. 11, 2019 in related application No. 16814207.3.

(Continued)

*Primary Examiner* — David J Walczak
(74) *Attorney, Agent, or Firm* — Renner Kenner Greive Bobak Taylor & Weber

(57) ABSTRACT

The present invention is a direct liquid type of writing tool including a pen tip; a columnar ink absorbent body connected to a rear end of the pen tip; an ink tank arranged on the ink absorbent body; and a plurality of communicating tubes for connecting the absorbent body and the ink tank. A front end of each of the communicating tubes is located in the ink absorbent body, and has a sloped surface facing an outer periphery side of the absorbent body. Each of the communicating tubes has an opening in the sloped surface at the front end and each has a tip end region adjacent to the opening and extending more frontward than the opening, and the tip end region forms a pressing part configured to press inside of the absorbent body when each of the tubes is inserted frontward from a rear end of the absorbent body.

23 Claims, 13 Drawing Sheets

(58) Field of Classification Search
CPC ..... B43K 1/015; B43K 5/809; B43K 8/06; B43K 5/02
See application file for complete search history.

(56) References Cited

U.S. PATENT DOCUMENTS

| | | | | |
|---|---|---|---|---|
| 7,578,631 | B2 * | 8/2009 | Kurita | B43K 8/06 401/198 |
| 2006/0054036 | A1 | 3/2006 | Kurita et al. | 101/324 |
| 2013/0004231 | A1 | 1/2013 | Nakatani et al. | 401/198 |
| 2016/0288561 | A1 | 10/2016 | Hoshino | B43K 5/145 |

OTHER PUBLICATIONS

International Search Report dated Jul. 12, 2016 (translation) in related application No. PCT/JP2016/067528.

* cited by examiner

DIRECT LIQUID TYPE OF WRITING TOOL

CROSS-REFERENCE TO RELATED APPLICATION

This is a § 371 application of International Patent Application No. PCT/JP2016/067528, filed Jun. 13, 2016, which claims benefit of Japanese Patent Application No. 2015-129296, and which is incorporated herein by reference.

TECHNICAL FIELD

The present invention relates to a direct liquid type of writing tool. In details, the present invention relates to a direct liquid type of writing tool in which ink is stored in an ink tank and in which an ink absorbent body is interposed between the ink tank and a pen tip.

BACKGROUND ART

Conventionally, regarding such a direct liquid type of writing tool, for example, JP-A-2006-212884 has disclosed a direct liquid type of writing tool comprising: a pen tip; an ink absorbent body connected to a rear end of the pen tip; an ink tank arranged on a rear side of the ink absorbent body; and communicating tubes for connecting the ink tank and the ink absorbent body. In this direct liquid type of writing tool, two communicating tubes are provided in parallel with a space therebetween, and a front end of each of the two communicating tubes is opened. The ink absorbent body has a high-density portion, and a low-density portion rearward adjacently connected to the high-density portion. The front end of each of the communicating tubes and a rear end of the pen tip are connected to the high-density portion. In addition, JP-A-2006-212884 has disclosed that, when the front end of each of the communicating tubes is inserted from the rear end of the ink absorbent body, the front end of each of the communicating tubes presses the inside of the ink absorbent body frontward so that the high-density portion is formed in the ink absorbent body in the vicinity of the front end of each of the communicating tubes.

In the direct liquid type of writing tool disclosed in JP-A-2006-212884, the front end of each of the communicating tubes has a sloped cut surface. The sloped cut surface (opening of the front end of the communicating tube) faces toward a central axis of the ink absorbent body. Thus, according to the inventors of the present patent application, in such a conventional direct liquid type of writing tool, the ink absorbent body is pressed too much in the vicinity of the front end of each of the communicating tubes, so that ink discharging performance from the pen tip may be deteriorated. In particular, this concern may be remarkable if the outer diameter of the barrel is made smaller to make the barrel thinner, and thus if the outer diameter of the ink absorbent body and the distance between the front-end openings of the communicating tubes are made smaller.

SUMMARY OF INVENTION

The present invention has been made to solve the above conventional problems. The object of the present invention is to provide a direct liquid type of writing tool in which a proper high-density portion is formed in an ink absorbent body in a vicinity of a front end of each of communicating tubes so that sufficient ink discharging performance from a pen tip can be obtained, even if the distance between the front-end openings of the communicating tubes is made smaller.

In the present specification, the term "front" means the pen-tip side, and the term "rear" means the opposite side.

The first aspect of the present invention is a direct liquid type of writing tool comprising: a pen tip; an ink absorbent body connected to a rear end of the pen tip; an ink tank arranged on a rear side of the ink absorbent body, configured to store ink directly; and a plurality of communicating tubes for connecting the ink tank and ink absorbent body; wherein a front end of each of the communicating tubes is opened, the front end of each of the communicating tubes is configured to press inside of the ink absorbent body when the front end of each of the communicating tubes is inserted frontward from a rear end of the ink absorbent body, the front end of each of the communicating tubes is located in the ink absorbent body, the front end of each of the communicating tubes has a sloped surface that goes radially inward toward the front side, and the opening of the front end of each of the communicating tubes faces radially outward.

According to the direct liquid type of writing tool of the first aspect, the front end of each of the communicating tubes has the sloped surface that goes radially inward toward the front side, and the opening of the front end of each of the communicating tubes faces radially outward. Thus, the ink absorbent body is not pressed too much in the vicinity of the front end of each of the communicating tubes, so that sufficient ink discharging performance from the pen tip can be obtained. In particular, according to the direct liquid type of writing tool of the first aspect, even if the outer diameter of the barrel is made smaller to make the barrel thinner, and thus even if the outer diameter of the ink absorbent body and the distance between the front-end openings of the communicating tubes are made smaller, the ink absorbent body is properly pressed in the vicinity of the front end of each of the communicating tubes, so that a proper high-density portion can be formed in the ink absorbent body in the vicinity of the front end of each of the communicating tubes. Thus, replacement of the ink and air can be smoothly conducted via the respective communicating tubes, so that the ink discharging performance from the pen tip is not deteriorated.

Next, the second aspect of the present invention further requires that, in the direct liquid type of writing tool of the first aspect, respective lateral walls of the communicating tubes are connected by a connecting part, and that a front-end region of the connecting part is located more frontward than the front-end opening of each of the communicating tubes.

According to the direct liquid type of writing tool of the second aspect, the respective lateral walls of the communicating tubes are connected by the connecting part, and the front-end region of the connecting part is located more frontward than the front-end opening of each of the communicating tubes. Thus, the ink absorbent body is more properly pressed in the vicinity of the front end of each of the communicating tubes, so that a proper high-density portion can be formed in the ink absorbent body in the vicinity of the front end of each of the communicating tubes.

Next, the third aspect of the present invention further requires that, in the direct liquid type of writing tool of the second aspect, the front-end region of the connecting part has a plurality of sloped surfaces that goes radially inward toward the front side, and that each of the sloped surfaces of the front-end region of the connecting part is continuously connected to the sloped surface at the front end of each of the communicating tubes.

According to the direct liquid type of writing tool of the third aspect, the front-end region of the connecting part has the plurality of sloped surfaces that goes radially inward toward the front side, and each of the sloped surfaces of the front-end region of the connecting part is continuously connected to the sloped surface at the front end of each of the communicating tubes. Thus, each of the communicating tubes can be more smoothly inserted into the ink absorbent body, so that a proper high-density portion can be formed in the ink absorbent body in the vicinity of the front end of each of the communicating tubes.

Next, the fourth aspect of the present invention further requires that, in the direct liquid type of writing tool of any of the first to third aspects, the front end of each of the communicating tubes has a planar sloped surface.

According to the direct liquid type of writing tool of the fourth aspect, the front end of each of the communicating tubes has the planar sloped surface. Thus, each of the communicating tubes can be more smoothly inserted into the ink absorbent body, so that a proper high-density portion can be formed in the ink absorbent body in the vicinity of the front end of each of the communicating tubes.

In addition, in relation to the first aspect, the fifth aspect of the present invention is a direct liquid type of writing tool comprising: a pen tip; a columnar ink absorbent body connected to a rear end of the pen tip; an ink tank arranged on a rear side of the ink absorbent body; and a plurality of communicating tubes for connecting the ink absorbent body and the ink tank; wherein a front end of each of the communicating tubes is located in the ink absorbent body, and is configured to have a sloped surface facing toward an outer periphery side of the ink absorbent body, each of the communicating tubes has an opening in the sloped surface at the front end, each of the communicating tubes has a tip end region adjacent to the opening and extending more frontward than the opening, and the tip end region forms a pressing part configured to press inside of the ink absorbent body when each of the communicating tubes is inserted frontward from a rear end of the ink absorbent body.

According to the direct liquid type of writing tool of the fifth aspect, the front end of each of the communicating tubes is configured to have the sloped surface facing toward the outer periphery side of the ink absorbent body, has the opening in the sloped surface, and has the tip end region adjacent to the opening and extending more frontward than the opening, and the tip end region forms the pressing part configured to press the inside of the ink absorbent body. Thus, the ink absorbent body is pressed not too much in the vicinity of the tip end region of each of the communicating tubes, so that sufficient ink discharging performance from the pen tip can be obtained. In particular, even if the outer diameter of the barrel is made smaller to make the barrel thinner, and thus even if the outer diameter of the ink absorbent body and the distance between the front-end openings of the communicating tubes are made smaller, the ink absorbent body is properly pressed in the vicinity of the tip end region of each of the communicating tubes, so that a proper (desired) high-density portion can be formed in the ink absorbent body in the vicinity of the tip end region of each of the communicating tubes. As a result, replacement of the ink and air can be smoothly conducted via the respective communicating tubes, so that the ink discharging performance from the pen tip is not deteriorated.

At least at the time of filing the present application, the scope of the present invention does not exclude a manner wherein the communicating tubes are separate from each other.

However, it is preferable that respective lateral walls of the communicating tubes are connected by a connecting part. In this case, it becomes easier to insert the respective communicating tubes into the ink absorbent body.

In addition, in this case, it is further preferable that a front-end region of the connecting part extends more frontward than the opening of each of the communicating tubes so as to form the pressing part together with the tip end region of each of the communicating tubes. In this case, the ink absorbent body is more properly pressed in the vicinity of the tip end region of each of the communicating tubes, so that a more proper high-density portion can be formed. As a result, the replacement of the ink and the air can be more smoothly conducted via the respective communicating tubes.

In addition, in this case, it is further preferable that the front-end region of the connecting part has one or more connecting-part sloped surfaces continuous from the sloped surface of each of the communicating tubes. In this case, insertion of the respective communicating tubes into the ink absorbent body can be more smoothly conducted. In addition, in this case as well, the ink absorbent body is more properly pressed in the vicinity of the tip end region of each of the communicating tubes, so that a more proper high-density portion can be formed. As a result, the replacement of the ink and the air can be more smoothly conducted via the respective communicating tubes.

At least at the time of filing the present application, the number of the communicating tubes is not limited.

However, it is preferable that the number of the communicating tubes is two. If the number is two, one of them serves for supply of the ink, and the other of them serves for replacement by the air, so that the replacement of the ink and the air can be conducted more efficiently.

The sloped surface of the front end of each of the communicating tubes may be planar, convexly curved or concavely curved.

In addition, the above second aspect may be substantially redefined as follows. That is, the sixth aspect of the present invention is a direct liquid type of writing tool comprising: a pen tip; a columnar ink absorbent body connected to a rear end of the pen tip; an ink tank arranged on a rear side of the ink absorbent body; and a joint communicating tube having a plurality of flow paths for connecting the ink absorbent body and the ink tank; wherein a front end of the joint communicating tube is located in the ink absorbent body, and has such a configuration that each of the flow paths has an opening in a sloped surface facing toward an outer periphery side of the ink absorbent body, the joint communicating tube has a tip end region adjacent to the opening and extending more frontward than the opening, and the tip end region forms a pressing part configured to press inside of the ink absorbent body when the joint communicating tube is inserted frontward from a rear end of the ink absorbent body.

According to the direct liquid type of writing tool of the sixth aspect, the front end of the joint communicating tube has such a configuration that each of the flow paths has the opening in the sloped surface facing toward the outer periphery side of the ink absorbent body, the joint communicating tube has the tip end region adjacent to the opening and extending more frontward than the opening, and the tip end region forms the pressing part configured to press the inside of the ink absorbent body. Thus, the ink absorbent body is pressed not too much in the vicinity of the tip end region of the joint communicating tube, so that sufficient ink discharging performance from the pen tip can be obtained. In particular, even if the outer diameter of the barrel is made smaller to make the barrel thinner, and thus even if the outer diameter of the ink absorbent body and the distance between the front-end openings of the joint communicating tube are made smaller, the ink absorbent body is properly pressed in the vicinity of the tip end region of the joint communicating tube, so that a proper (desired) high-density portion can be formed in the ink absorbent body in the vicinity of the tip end region of the joint communicating tube. As a result, replacement of the ink and air can be smoothly conducted via the respective flow paths, so that the ink discharging performance from the pen tip is not deteriorated.

For example, the front end of the joint communicating tube is configured to have a plurality of sloped surfaces, each of which faces toward the outer periphery side of the ink absorbent body, and each of the flow paths corresponds to each of the plurality of sloped surfaces, and has the opening in the corresponding sloped surface.

In this case, it is preferable that the number of the flow paths is two. If the number is two, one of them serves for supply of the ink, and the other of them serves for replacement by the air, so that the replacement of the ink and the air can be conducted more efficiently.

In addition, in this case, each of the sloped surfaces may be planar, convexly curved or concavely curved.

Alternatively, for example, the front end of the joint communicating tube has the shape of a rotating body rotationally symmetric around an axis. In more detail, the front end of the joint communicating tube may have the shape of a conical or frustoconical body. Alternatively, the front end of the joint communicating tube may have the shape of a part of a spherical body.

Next, the seventh aspect of the present invention is a direct liquid type of writing tool comprising: a pen tip; a columnar ink absorbent body connected to a rear end of the pen tip; an ink tank arranged on a rear side of the ink absorbent body; and a communicating tube for connecting the ink absorbent body and the ink tank; wherein a front end of the communicating tube is located in the ink absorbent body, and has such a configuration that each of a plurality of openings is opened in a sloped surface facing toward an outer periphery side of the ink absorbent body, the communicating tube has a tip end region adjacent to the opening and extending more frontward than the opening, and the tip end region forms a pressing part configured to press inside of the ink absorbent body when the communicating tube is inserted frontward from a rear end of the ink absorbent body.

According to the direct liquid type of writing tool of the sixth aspect, the front end of the communicating tube has such a configuration that each of the plurality of openings is opened in the sloped surface facing toward the outer periphery side of the ink absorbent body, the communicating tube has the tip end region adjacent to the opening and extending more frontward than the opening, and the tip end region forms the pressing part configured to press the inside of the ink absorbent body. Thus, the ink absorbent body is pressed not too much in the vicinity of the tip end region of the communicating tube, so that sufficient ink discharging performance from the pen tip can be obtained. In particular, even if the outer diameter of the barrel is made smaller to make the barrel thinner, and thus even if the outer diameter of the ink absorbent body and the distance between the front-end openings of the communicating tube are made smaller, the ink absorbent body is properly pressed in the vicinity of the tip end region of the communicating tube, so that a proper (desired) high-density portion can be formed in the ink absorbent body in the vicinity of the tip end region of the communicating tube. As a result, replacement of the ink and air can be smoothly conducted via the respective openings, so that the ink discharging performance from the pen tip is not deteriorated.

For example, the front end of the communicating tube is configured to have a plurality of sloped surfaces, each of which faces toward the outer periphery side of the ink absorbent body, and each of the plurality of openings corresponds to each of the plurality of sloped surfaces, and is opened in the corresponding sloped surface.

In this case, it is preferable that the number of the openings is two. If the number is two, one of them serves for supply of the ink, and the other of them serves for replacement by the air, so that the replacement of the ink and the air can be conducted more efficiently.

In addition, in this case, each of the sloped surfaces may be planar, convexly curved or concavely curved.

Alternatively, for example, the front end of the communicating tube has the shape of a rotating body rotationally symmetric around an axis. In more detail, the front end of the communicating tube may have the shape of a conical or frustoconical body. Alternatively, the front end of the communicating tube may have the shape of a part of a spherical body.

DESCRIPTION OF EMBODIMENTS

Figure 1:
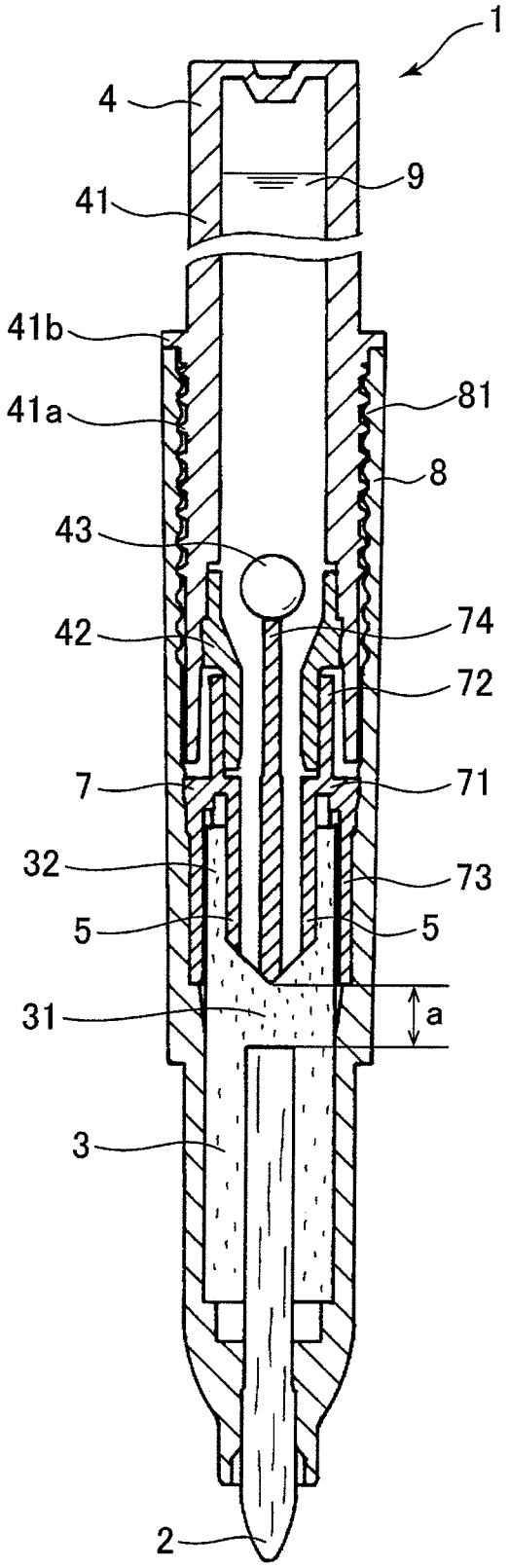
FIG. 1 is a longitudinal section view of a direct liquid type of writing tool according to a first embodiment of the present invention.
Figure 2:
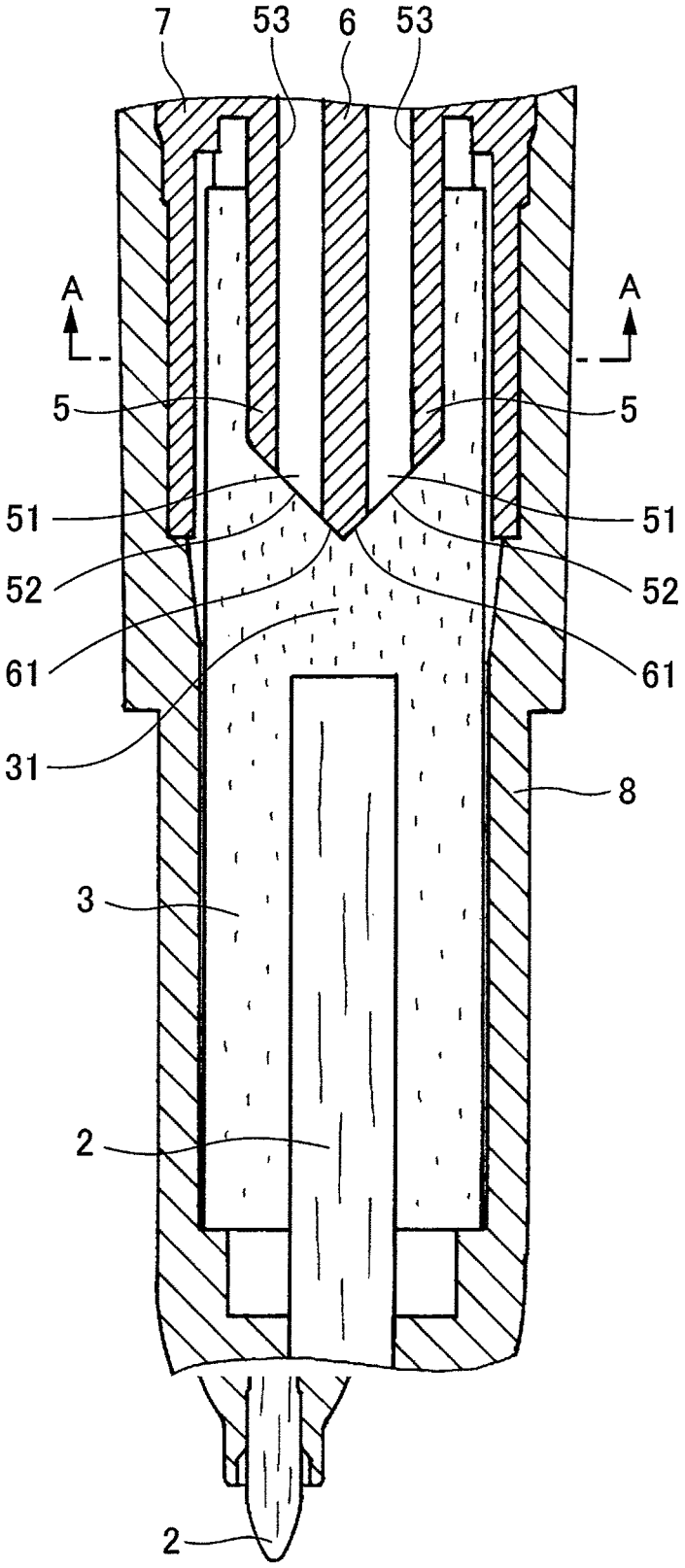
FIG. 2 is an enlarged longitudinal section view of a main part of FIG. 1.
Figure 3:
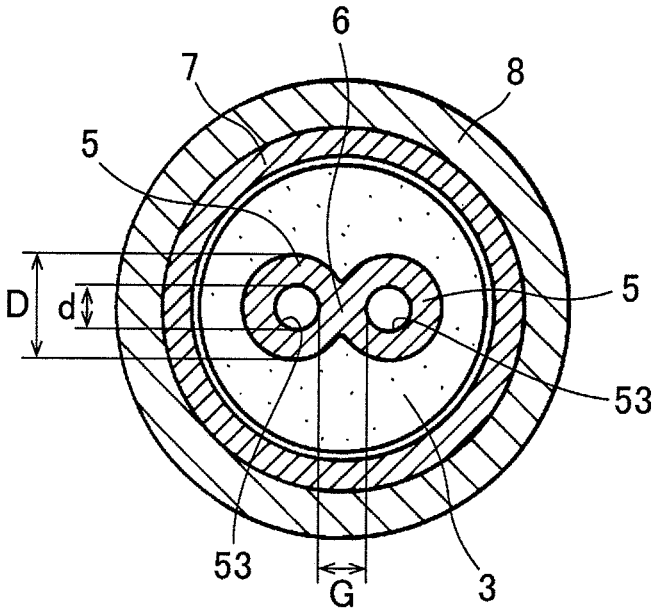
FIG. 3 is a cross section view taken along line A-A of FIG. 2.
Figure 4:
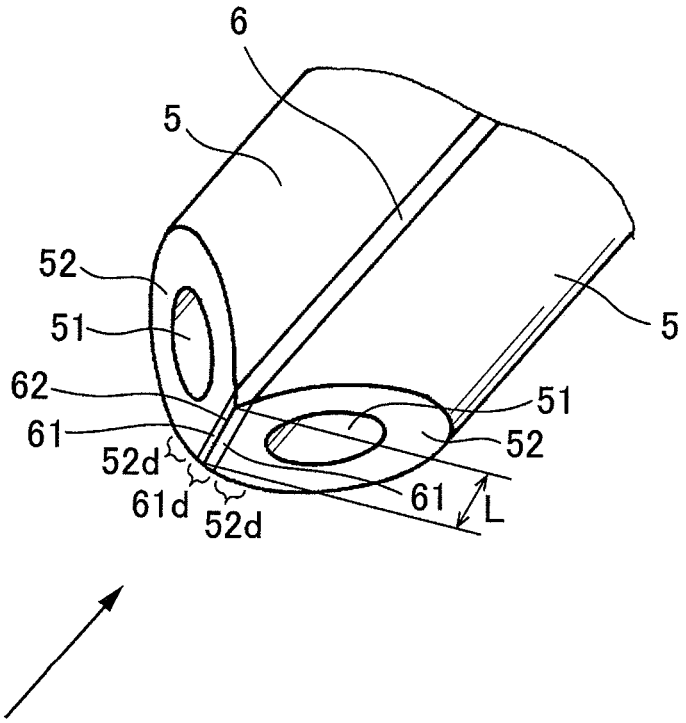
FIG. 4 is a perspective view of the front end of the communicating tube shown in FIG. 2.

A direct liquid type of writing tool according to a first embodiment of the present invention is shown in FIGS. 1 to 4. FIG. 1 is a longitudinal section view of the direct liquid type of writing tool 1 according to the first embodiment of the present invention. FIG. 2 is an enlarged longitudinal section view of a main part of FIG. 1. FIG. 3 is a cross section view taken along line A-A of FIG. 2. FIG. 4 is a perspective view of the front end of the communicating tube shown in FIG. 2. The first embodiment relates to the above first to fifth aspects of the present invention.

As shown in FIG. 1, the direct liquid type of writing tool 1 according to the present embodiment comprises: a pen tip 2; an ink absorbent body 3 connected to a rear end of the pen tip 2; an intermediate member 7 arranged on a rear side of the ink absorbent body; an ink tank 4 arranged on the rear side of the intermediate member 7; a barrel 8 holding the pen tip 2 at a front end thereof; and a removable cap (not shown) provided on a front side of the pen tip 2. The ink absorbent body 3, the intermediate member 7 and a front portion of the ink tank 4 are contained in the barrel 8. Hereinafter, each element is explained in detail.

<Pen Tip>

The pen tip 2 of the present embodiment is a sticklike body made of synthetic resin fabric (such as polyester fabric, acrylic fabric, nylon fabric, etc.) by a resin processing. A front end of the pen tip 2 is ground into a shell-shape.

<Ink Absorbent Body>

As shown in FIGS. 1 and 2, the ink absorbent body 3 of the present embodiment is a columnar processed body made of a bundle of synthetic resin fabric (such as polyester fabric). An outer peripheral surface of the ink absorbent body 3 is covered with a cylindrical outer skin made of synthetic resin. A rear end of the pen tip 2 is configured to be stuck and inserted into an axial center at a front end of the ink absorbent body 3. Then, after the sticking and inserting, the rear end of the pen tip 2 is located inside the ink absorbent body 3.

<Barrel>

The barrel 8 of the present embodiment is a tubular member made of synthetic resin (such as polypropylene, polyethylene, etc.) by an injection molding. As shown in FIG. 1, the barrel 8 consists of: a tapered part holding an outer peripheral surface of the pen tip 2; and a main part connected to the tapered part on the rear side in which the ink absorbent body 3 and the intermediate member 7 are contained.

The ink tank 4 is removably attached to a rear-end opening of the barrel 8 (main part). Specifically, a male threaded portion 41*a* is formed on an front outer peripheral surface of the ink tank 4, a female threaded portion 81 is formed on an inner peripheral surface of the rear-end opening of the barrel 8 (main part), and these threaded portions are engaged so that the front outer peripheral surface of the ink tank 4 and the inner peripheral surface of the rear-end opening of the barrel 8 (main part) are removably attached to each other.

<Intermediate Member>

The intermediate member 7 of the present embodiment is made of synthetic resin (such as polypropylene, polyethylene, etc.) by an injection molding. As shown in FIG. 1, the intermediate member 7 consists of: a partition 71 separating the ink absorbent body 3 and the ink tank 4; a plurality of (specifically, two connected) communicating tubes 5 projecting frontward from a front surface of the partition 71 and configured to be stuck into and connected to the ink absorbent body 3; a connecting tube 72 projecting rearward from a rear surface of the partition 71 and configured to be fitted to a front-end opening of the ink tank 4; and a fitting tubular part 73 projecting frontward from the front surface of the partition 71 and configured to be fitted on an inner peripheral surface of the barrel 8 (main part).

A space surrounded by the barrel 8, the partition 71 and the fitting tubular part 73 forms an absorbent-body containing part, in which the ink absorbent body 3 is contained.

In addition, in the present embodiment, a stick part 74 projecting rearward is integrally formed at an axial center at the rear surface of the partition 71. The stick part 74 is configured to push a plug 43 of the ink tank 4 rearward, which is explained below.

In the present embodiment, an inner surface of the connecting tube 72 and a front-end outer surface of the ink tank 4 are fitted to each other. However, an outer surface of the connecting tube 72 and a front-end inner surface of the ink tank 4 may be fitted to each other.

In the present embodiment, the partition 71 has the shape of a disk, and each of the respective communicating tubes 5, the connecting tube 72 and the fitting tubular part 73 has a cylindrical shape.

In the present embodiment, the partition 71, the respective communicating tubes 5, the connecting tube 72, the fitting tubular part 73 and the stick part 74 are integrally connected. That is, the partition 71, the respective communicating tubes 5, the connecting tube 72, the fitting tubular part 73 and the stick part 74 are formed as a single piece, as the intermediate member 7.

<Communicating Tube>

A flow path 53 is provided in an axial direction in each of the communicating tubes 5. The flow path 53 is opened at both ends of the communicating tube 5. A front end of each of the communicating tubes 5 is opened in the ink sorbent body 3, and a rear end of each of the communicating tubes 5 is opened in the ink tank 4 on the rear side of the ink absorbent body 3. The respective communicating tubes 5 are arranged in parallel between the ink absorbent body 3 and the ink tank 4. That is, a plurality of (specifically, two) independent flow paths 53 are arranged in parallel between the ink absorbent body 3 and the ink tank 4. The respective flow paths 53 of the present embodiment run through the partition 71, inner than the connecting tube 72 but deviated (away) from the axial center. In the present embodiment, each flow path 53 of the communicating tube 5 has a circle shape in transverse section.

<Sloped Surface>

A sloped surface 52 is formed at the front end of each of the communicating tubes 5. The sloped surface 52 faces toward the outer periphery side of the ink absorbent body 3. That is, the sloped surface 52 has a shape such that the sloped surface 52 goes radially inward toward the front side. In other words, the sloped surface 52 has a shape such that the sloped surface 52 goes towards the axial center of the intermediate member 7 and the axial center of the ink absorbent body 3, toward the front side.

The opening 51 of each communicating tube 5 (each flow path 53) is formed in the sloped surface 52 facing toward the outer periphery side of the ink absorbent body 3 (facing radially outward). The opening 51 looks like an elliptical shape when viewed from directly above of the sloped surface 52.

Specifically, the sloped surface 52 of the front end of the communicating tube 5 may be planar, convexly curved, concavely curved or the like. In the present embodiment, the planar sloped surface 52 is adopted.

<Connecting Part>

In the present embodiment, respective lateral walls of the communicating tubes 5 are integrally connected by a connecting part 6.

A front end of the connecting part 6 is located more frontward than the respective openings of the communicating tubes 5. A front-end region of the connecting part 6 also has a sloped surface 61 facing toward the outer periphery side of the ink absorbent body 3, i.e., a sloped surface 61 goring radially inward toward the front side. In other words, the sloped surface 61 has a shape such that the sloped surface 61 goes towards the axial center of the intermediate member 7 and the axial center of the ink absorbent body 3, toward the front side.

In the present embodiment, a plurality of (specifically, two) sloped surfaces 61 is formed at the connecting part 6. Specifically, each of the plurality of sloped surface 61 may be planar, convexly curved, concavely curved or the like. In the present embodiment, the planar sloped surface 61 is adopted, and is smoothly continuous from the adjacent sloped surface 52 of the communicating tube 5.

In the present embodiment, the plurality of (specifically, two) sloped surfaces 61 are adjacent to each other (intersect to form a certain angle (in this case, 90 degrees: see FIG. 1)) on the opposite side with respect to the portions continuous from the sloped surfaces 52, so that a ridge-like top portion 62 is formed at the foremost end (tip end) of the connecting part 6. In the present embodiment, the top portion 62 of the connecting part 6 is located to intersect the axial center of the ink absorbent body 3.

<High-Density Portion>

The front ends of the respective communicating tube 5 and the front end of the connecting part 6 are integrally stuck and inserted into the ink absorbent body 3, frontward from the rear end of the ink absorbent body 3, and positioned in the vicinity of the rear end of the pen tip 2. When the front ends of the respective communicating tube 5 and the front end of the connecting part 6 are stuck and inserted into the ink absorbent body 3, the front ends of the respective communicating tube 5 and the front end of the connecting part 6 push aside the fabric of the ink absorbent body 3 as well as press the fabric of the ink absorbent body 3 frontward. In particular, the tip end regions 52*d* of the communicating tubes 5 extending more frontward than the respective openings 51 and the region 61*d* of the connecting tube 6 extending more frontward than the respective openings 51 serve as the pressing part in cooperation. Because of this pressing function, fabric density of the ink absorbent body 3 in the vicinity of the front end of each of the communicating tubes 5 becomes higher than fabric density of the ink absorbent body 3 outside the vicinity of the front end of each of the communicating tubes 5. That is, in the ink absorbent body 3, a high-density portion 31 whose fabric density is higher is formed in the vicinity of the front end of each of the communicating tubes 5, while a low-density portion 32 whose fabric density is lower is formed outside the vicinity of the front end of each of the communicating tubes 5 (see FIG. 1).

A capillary force is greater in the high-density portion 31 in which the fabric density is higher, and is lower in the low-density portion 32 in which the fabric density is lower. Thus, the ink in the ink absorbent body 3 can be impregnated preferentially in the high-density portion 31, rather than in the low-density portion 32. The ink impregnated in the high-density portion 31 surely liquid-seals the respective openings 51 of the communicating tubes 5. This effectively prevents the ink in the ink tank 4 from leaking from the pen tip 2 too much.

As described above, the front ends of the respective communicating tubes 5 are arranged away from the axial center of the ink absorbent body 3. Preferably, the front ends of the respective communicating tubes 5 are arranged on the same circle whose center is the axial center of the ink absorbent body 3, at regular circumferential intervals. In the present embodiment, since the number of the communicating tubes 5 is two, the two communicating tubes 5 are arranged at 180 degree positions symmetric with respect to the axial center of the ink absorbent body 3. On the other hand, the pen tip 2 is located on the axial center of the ink absorbent body 3. Thus, the front ends of the respective communicating tubes 5 are not directly connected to the rear end of the pen tip 2 (contactless), but can allow the ink to communicate with the pen tip 2 via the inside of the ink absorbent body 3, in particular the high-density portion 31. Herein, it is preferable that the front ends of the respective communicating tubes 5 are located more rearward than the rear end of the pen tip 2.

<Ink Tank>

As shown in FIG. 1, the ink tank 4 of the present embodiment consists of: a tubular main part 41 having a front open end and a rear closed end; a tubular front part 42 fixed in an inner surface of the front open end of the main part 41; and a plug 43 fitted in an inner surface of the tubular front part 42. The main part 41 and the tubular front part 42 are made of synthetic resin by an injection molding. The plug 43 consists of a ball made of a metal or synthetic resin.

A male threaded portion 41*a* and a flange portion 41*b* positioned on the rear side of the male threaded portion 41*a* are integrally formed on an outer peripheral surface of the main part 41. The male threaded portion 41*a* of the main part 41 is configured to engage with the female threaded portion 81 formed on the inner peripheral surface of the rear-end opening of the barrel 8. When the ink tank 4 is fully connected, the flange portion 41*b* comes in contact with the rear end of the barrel 8.

The ink tank 4 is closed by the plug 43 before the ink tank 4 is connected to the barrel 8. When the ink tank 4 is used, the plug 43 is pushed and removed into the ink tank 4 by the stick part 74 of the intermediate member 7, so that the ink tank 4 is opened. The ink 9 is directly stored in the ink tank 4. The kind of the ink to be stored in the ink tank 4 may be any of water-based ink or oil-based ink.

The outer peripheral surface of the front-end opening of the ink tank 4 (in detail, the outer peripheral surface of the front end of the tubular front part 42) is removably fitted in the inner peripheral surface of the connecting tube 72 of the intermediate member 7. When the ink in the ink tank 4 is consumed so that the writing ability is lost, the used ink tank 4 is removed from the connecting tube 72, and a new ink tank 4 in which the ink is full is fitted to the connecting tube 72. Thus, the writing ability is revived. Herein, the front-end opening of the new ink tank 4 is closed by the plug 43. When the front-end opening of the new ink tank 4 is fitted to the connecting tube 72, the plug 43 is pushed and removed rearward by the stick part 74, so that the new ink tank 4 is opened.

The direct liquid type of writing tool 1 of the present embodiment corresponds to the first aspect of the present invention. The front end of each of the communicating tubes 5 has the sloped surface 52 that goes radially inward toward the front side, and the opening 51 of the front end of each of the communicating tubes 5 faces radially outward. Thus, the ink absorbent body 3 is not pressed too much in the vicinity of the front end of each of the communicating tubes 5, so that sufficient ink discharging performance from the pen tip 2 can be obtained. In particular, according to the direct liquid type of writing tool 1 of the present embodiment, even if the outer diameter of the barrel 8 is made smaller to make the barrel thinner 8, and thus even if the outer diameter of the ink absorbent body 3 and the distance between the front-end openings 51 of the communicating tubes 5 are made smaller, the ink absorbent body 3 is properly pressed in the vicinity of the front end of each of the communicating tubes 5, so that a proper high-density portion 31 can be formed in the ink absorbent body 3 in the vicinity of the front end of each of the communicating tubes 5. Thus, replacement of the ink and air can be smoothly conducted via the respective communicating tubes 5, so that the ink discharging performance from the pen tip 2 is not deteriorated.

The direct liquid type of writing tool 1 of the present embodiment corresponds to the second aspect of the present invention. The respective lateral walls of the communicating tubes 5 are connected by the connecting part 6, and the front-end region of the connecting part 6 is located more frontward than the front-end opening 51 of each of the communicating tubes 5. Thus, the ink absorbent body 3 is more properly pressed in the vicinity of the front end of each of the communicating tubes 5, so that a proper high-density portion 31 can be formed in the ink absorbent body 3 in the vicinity of the front end of each of the communicating tubes 5.

The direct liquid type of writing tool 1 of the present embodiment corresponds to the third aspect of the present invention. The front-end region of the connecting part 6 has the plurality of sloped surfaces 61 that goes radially inward toward the front side, and each of the sloped surfaces 61 of the front-end region of the connecting part 6 is continuously connected to the sloped surface 52 at the front end of each of the communicating tubes 5. Thus, each of the communicating tubes 5 can be more smoothly inserted into the ink absorbent body 3, so that a proper high-density portion 31 can be formed in the ink absorbent body 3 in the vicinity of the front end of each of the communicating tubes 5.

The direct liquid type of writing tool 1 of the present embodiment corresponds to the fourth aspect of the present invention. The front end of each of the communicating tubes 5 has the planar sloped surface 52. Thus, each of the communicating tubes 5 can be more smoothly inserted into the ink absorbent body 3, so that a proper high-density portion 31 can be formed in the ink absorbent body 3 in the vicinity of the front end of each of the communicating tubes 5.

The direct liquid type of writing tool 1 of the present embodiment corresponds to the fifth aspect of the present invention. The front end of each of the communicating tubes 5 is configured to have the sloped surface 52 facing toward the outer periphery side of the ink absorbent body 3, has the opening 51 in the sloped surface 52, and has the tip end region 52*d* adjacent to the opening 51 and extending more frontward than the opening 51, and the tip end region 52*d* forms the pressing part configured to press the inside of the ink absorbent body 3. Thus, the ink absorbent body 3 is pressed not too much in the vicinity of the tip end region 52*d* of each of the communicating tubes 5, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the distance between the front-end openings 51 of the communicating tubes 5 are made smaller, the ink absorbent body 3 is properly pressed in the vicinity of the tip end region 52*d* of each of the communicating tubes 5, so that a proper (desired) high-density portion 31 can be formed in the ink absorbent body 3 in the vicinity of the tip end region 52*d* of each of the communicating tubes 5. As a result, replacement of the ink and air can be smoothly conducted via the respective communicating tubes 5, so that the ink discharging performance from the pen tip 2 is not deteriorated.

In addition, according to the direct liquid type of writing tool 1 of the present embodiment, since the respective lateral walls of the communicating tubes 5 are connected by the connecting part 6, inserting the respective communicating tubes 5 into the ink absorbent body 3 becomes easier.

In addition, according to the direct liquid type of writing tool 1 of the present embodiment, since the front-end region 61*d* of the connecting part 6 extends more frontward than the opening 51 of each of the communicating tubes 5 so as to form the pressing part together with the tip end region 52*d* of each of the communicating tubes 5, the ink absorbent body 3 is more properly pressed in the vicinity of the tip end region 52*d* of each of the communicating tubes 5, so that a more proper high-density portion 31 is formed. As a result, the replacement of the ink and the air can be more smoothly conducted via the respective communicating tubes 5.

In addition, according to the direct liquid type of writing tool 1 of the present embodiment, since the front-end region 61*d* of the connecting part 6 has one or more connecting-part sloped surfaces continuous from the sloped surface 52 of each of the communicating tubes 5, insertion of the respective communicating tubes 5 into the ink absorbent body 3 can be more smoothly conducted. In addition, it is considered that this feature contributes to the fact that the ink absorbent body 3 is more properly pressed in the vicinity of the tip end region 52*d* of each of the communicating tubes 5 so that the more proper high-density portion 31 can be formed.

In addition, according to the direct liquid type of writing tool 1 of the present embodiment, since the number of the communicating tubes 5 is two, one of them serves for supply of the ink, and the other of them serves for replacement by the air, so that the replacement of the ink and the air can be conducted more efficiently.

In addition, in the present embodiment, it is important that the tip end regions 52*d* of the communicating tubes 5 extending more frontward than the respective openings 51 and the region 61*d* of the connecting tube 6 extending more frontward than the respective openings 51 serve as the pressing part in cooperation. In the present embodiment, the length L of the ridge-like top portion 62 (see FIG. 4) is α mm, and the separation distance G of the two flow paths 53 (see FIG. 3) is β mm. That is, it is important that at least the rectangular region of α mm×β mm when viewed from the front (when viewed in the arrow direction in FIG. 4) achieves the pressing function effectively between the two openings 51. The length L of the top portion 62 may be selected from a range of 0.5 mm to 4.0 mm, for example. The separation distance G between the two flow paths 53 may be selected from a range of 0.5 mm to 3.0 mm, for example.

As a supplemental explanation regarding the other sizes of the present embodiment, the diameter of the ink absorbent body 3 is about 5 to 13 mm, each flow path 53 has a circle shape in transverse section and the diameter d thereof (see FIG. 3) is about 0.5 to 3.0 mm, the outer diameter D of each communicating tube 5 (see FIG. 3) is about 1.5 to 5.0 mm, the distance a between the top portion 62 and the rear end of the pen tip 2 (see FIG. 1) is about 1.0 to 10 mm.

[Second Embodiment: Slit Gap]

In the above first embodiment, the lateral walls of the two communicating tubes 5 are connected by the connecting part 6. However, adoptable is any manner in which the lateral walls are not connected. Such an embodiment is shown in FIGS. 5 to 7 as a second embodiment.

Figure 5:
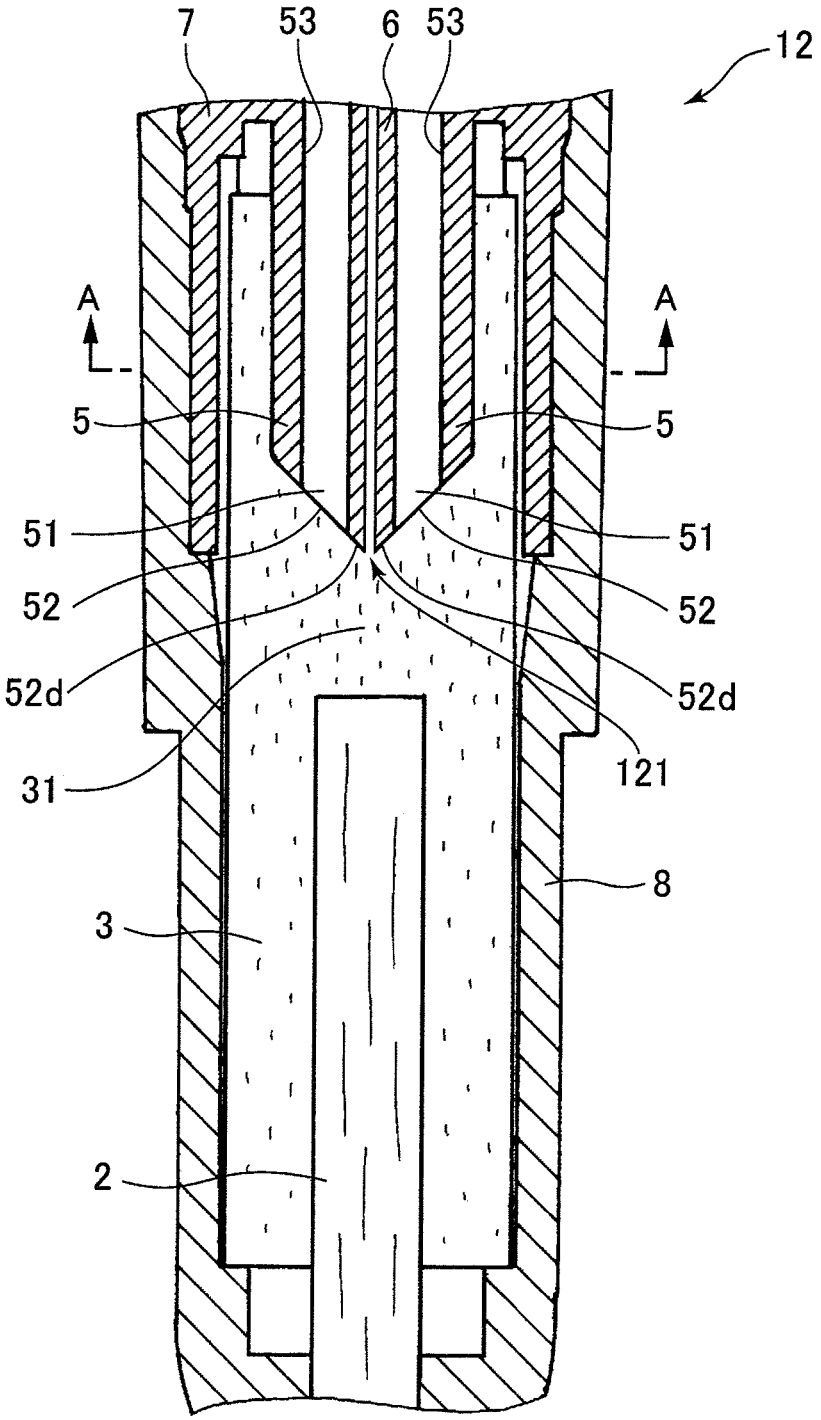
FIG. 5 is an enlarged longitudinal section view of a main part of a direct liquid type of writing tool according to a second embodiment of the present invention.

FIG. 5 is an enlarged longitudinal section view of a main part of a direct liquid type of writing tool 12 according to the second embodiment of the present invention. FIG. 6 is a cross section view taken along line A-A of FIG. 5. FIG. 7 is a perspective view of the front end of the communicating tube shown in FIG. 5. The second embodiment corresponds to the first and fifth aspects of the present invention.

Figure 6:
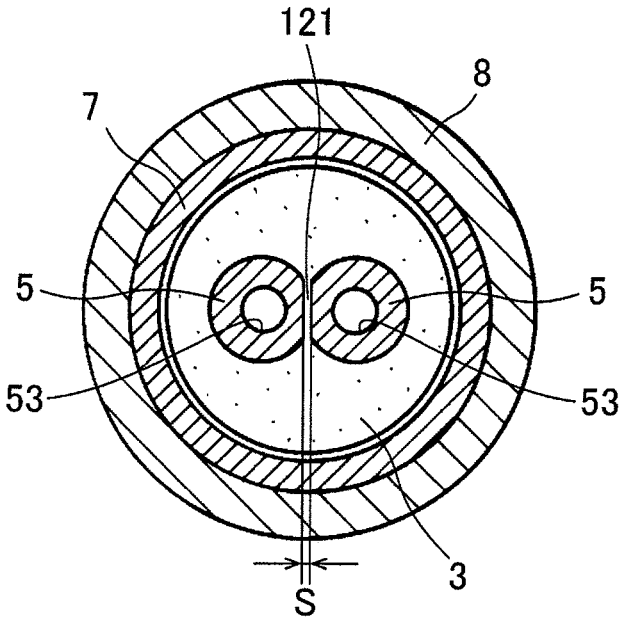
FIG. 6 is a cross section view taken along line A-A of FIG. 5.
Figure 7:
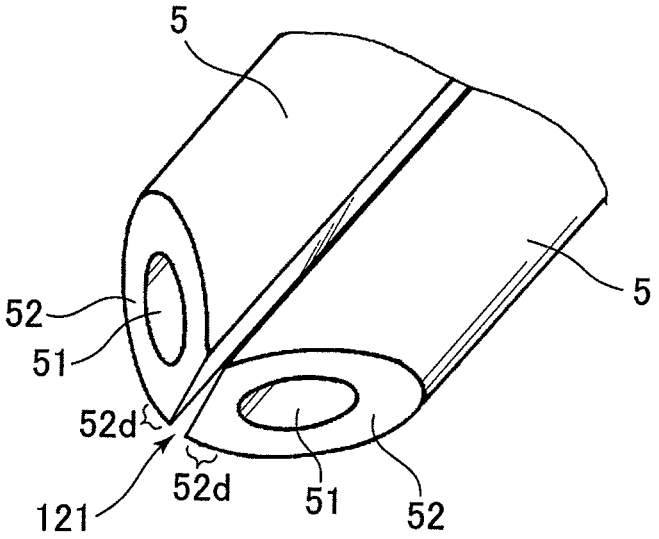
FIG. 7 is a perspective view of the front end of the communicating tube shown in FIG. 5.

As shown in FIGS. 5 to 7, in the direct liquid type of writing tool 12 according to the second embodiment, the two communicating tubes 5 are not connected by a connecting part, but there is a slit-like gap 122 between them. The separation width S by the slit-like gap 121 is 0.5 to 2.0 mm.

The other structure of the second embodiment is substantially the same as that of the direct liquid type of writing tool 1 according to the first embodiment. In FIGS. 5 to 7, the same parts as those of the first embodiment are shown by the same reference numerals, and detailed explanation thereof is omitted. Respective sizes of the second embodiment are substantially the same as those of the first embodiment.

According to the second embodiment as well, substantially the same effects as those of the first embodiment can be achieved. That is, the ink absorbent body 3 is pressed not too much in the vicinity of the tip end region 52*d* of each of the communicating tubes 5, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the distance between the front-end openings 51 of the communicating tubes 5 are made smaller, the ink absorbent body 3 is properly pressed in the vicinity of the tip end region 52*d* of each of the communicating tubes 5, so that a proper (desired) high-density portion 31 can be formed in the ink absorbent body 3 in the vicinity of the tip end region 52*d* of each of the communicating tubes 5. As a result, replacement of the ink and air can be smoothly conducted via the respective communicating tubes 5, so that the ink discharging performance from the pen tip 2 is not deteriorated.

[Third Embodiment: Joint Communicating Tube]

In the first embodiment, the lateral walls of the two communicating tubes 5 are connected by the connecting part 6. However, adoptable is any manner in which they are integrally formed from the beginning, i.e., in which one joint communicating tube 131 having two flow paths 53 is provided, instead of the two communicating tubes 5 each of which has the flow path 53. Such an embodiment is shown in FIGS. 8 and 9 as a third embodiment.

Figure 8:
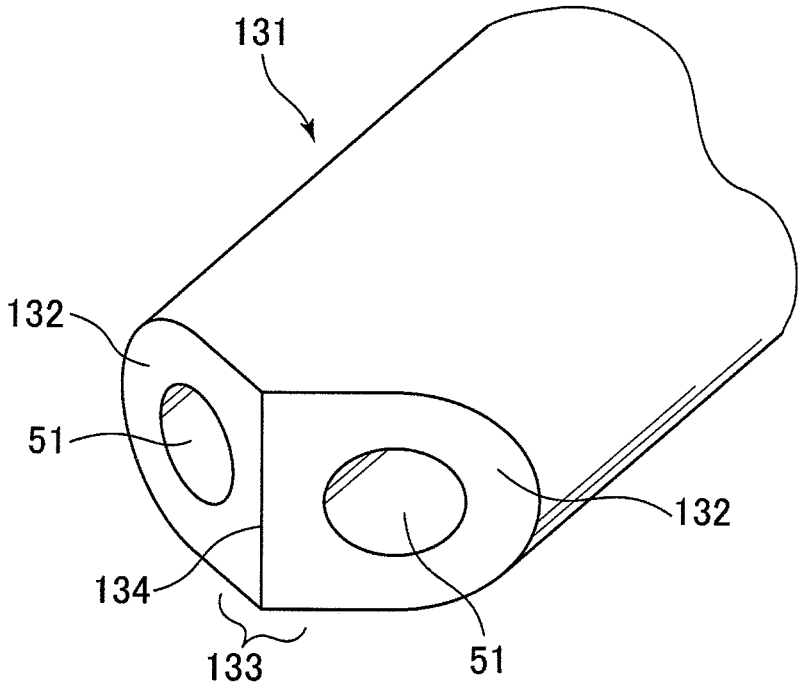
FIG. 8 is a perspective view of a front end of a joint communicating tube of a direct liquid type of writing tool according to a third embodiment of the present invention.

FIG. 8 is a perspective view of a front end of a joint communicating tube 131 of a direct liquid type of writing tool according to the third embodiment of the present invention. FIG. 9 is a longitudinal section view of the front end of the joint communicating tube 131 shown in FIG. 8. The third embodiment corresponds to the first to fourth and sixth aspects of the present invention.

Figure 9:
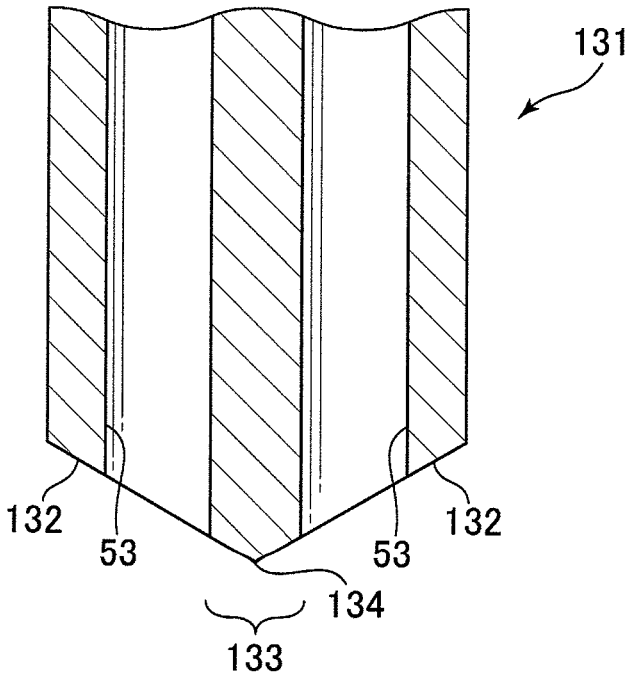
FIG. 9 is a longitudinal section view of the front end of the joint communicating tube shown in FIG. 8.

As shown in FIGS. 8 and 9, the direct liquid type of writing tool according the third embodiment has the joint communicating tube 131 having two flow paths 53, instead of the two communicating tubes 5 each of which has the flow path 53.

The front end of the joint communicating tube 131 is located in the ink absorbent body 3, and has such a configuration that each of the flow paths 53 has an opening 51 in a sloped surface 132 facing toward an outer periphery side of the ink absorbent body 3. In addition, the joint communicating tube 131 has a tip end region 133 adjacent to the respective openings 51 and extending more frontward than the respective openings 51. The tip end region 133 forms a pressing part configured to press inside of the ink absorbent body 3 when the joint communicating tube 131 is inserted frontward from a rear end of the ink absorbent body 3.

Furthermore, in the third embodiment, the front end of the joint communicating tube 131 is configured to have the two sloped surfaces 132, each of which faces toward the outer periphery side of the ink absorbent body 3, and each of the two flow paths 53 corresponds to each of the two sloped surfaces and has the opening 51 in the corresponding sloped surface 132. Then, the two sloped surfaces 132 are adjacent to each other (intersect to form a certain angle (in this case, 120 degrees: see FIG. 9), so that a ridge-like top portion 134 is formed at the foremost end (tip end) of the joint communicating tube 131. The top portion 134 of the third embodiment is also located to intersect the axial center of the ink absorbent body 3.

The other structure of the third embodiment is substantially the same as that of the direct liquid type of writing tool 1 according to the first embodiment. In FIGS. 8 and 9, the same parts as those of the first embodiment are shown by the same reference numerals, and detailed explanation thereof is omitted. Respective sizes of the third embodiment are substantially the same as those of the first embodiment.

According to the third embodiment as well, substantially the same effects as those of the first embodiment can be achieved. That is, the ink absorbent body 3 is pressed not too much in the vicinity of the tip end region 133 of the joint communicating tube 131, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the outer diameter of the joint communicating tube 131 are made smaller, the ink absorbent body 3 is properly pressed in the vicinity of the tip end region 133 of the joint communicating tube 131, so that a proper (desired) high-density portion 31 can be formed in the ink absorbent body 3 in the vicinity of the tip end region 133 of the joint communicating tube 131. As a result, replacement of the ink and air can be smoothly conducted via the respective flow paths 53, so that the ink discharging performance from the pen tip 2 is not deteriorated.

[Fourth Embodiment: Continuous Sloped Surface]

In the first and third embodiments, the ridge-like top portion 62, 134 is formed at the foremost end (tip end) of the connecting part 6 or the joint communicating tube 131. However, the present invention is not limited to those manners. Adoptable is any manner in which no ridge-like top portion is formed. Such an embodiment is shown in FIGS. 10 and 11 as a fourth embodiment.

Figure 10:
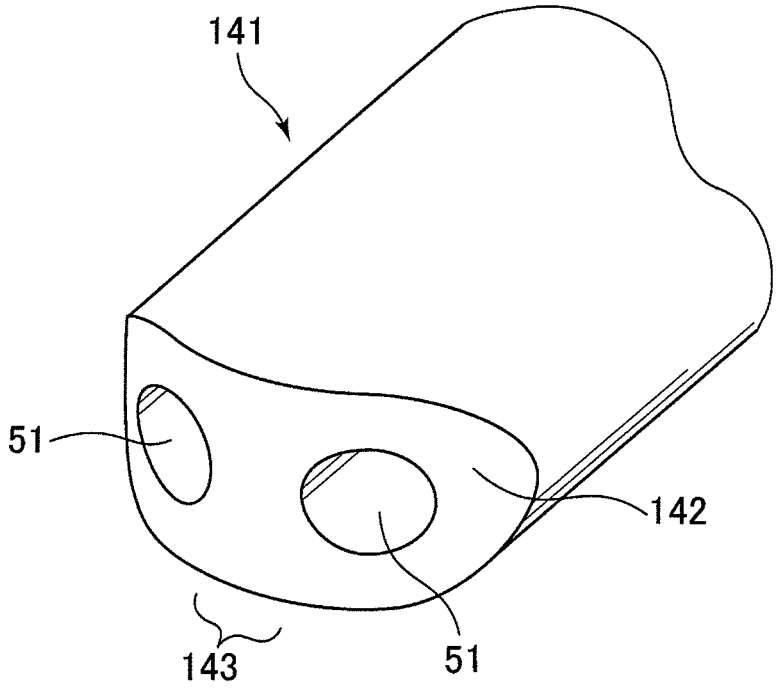
FIG. 10 is a perspective view of a front end of a joint communicating tube of a direct liquid type of writing tool according to a fourth embodiment of the present invention.

FIG. 10 is a perspective view of a front end of a joint communicating tube 141 of a direct liquid type of writing tool according to the fourth embodiment of the present invention. FIG. 11 is a longitudinal section view of the front end of the joint communicating tube 141 shown in FIG. 10. The fourth embodiment corresponds to the first to third and sixth aspects of the present invention.

Figure 11:
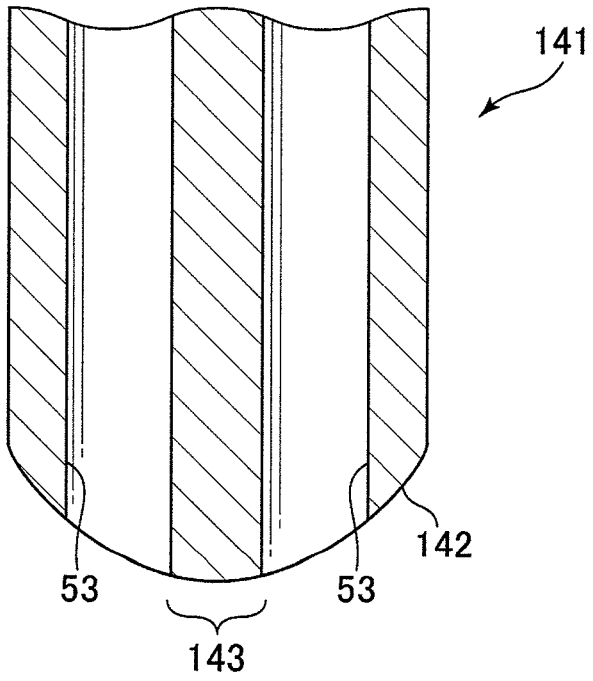
FIG. 11 is a longitudinal section view of the front end of the joint communicating tube shown in FIG. 10.

As shown in FIGS. 10 and 11, the front end of the joint communicating tube 141 is located in the ink absorbent body 3, and has such a configuration that each of the flow paths 53 has an opening 51 in a sloped surface 142 facing toward an outer periphery side of the ink absorbent body 3. In addition, the joint communicating tube 141 has a tip end region 143 adjacent to the respective openings 51 and extending more frontward than the respective openings 51. The tip end region 143 forms a pressing part configured to press inside of the ink absorbent body 3 when the joint communicating tube 141 is inserted frontward from a rear end of the ink absorbent body 3.

In addition, as shown in FIGS. 10 and 11, in the direct liquid type of writing tool according to the fourth embodiment as well, the front end of the joint communicating tube 141 is configured to have the two sloped surfaces 142, each of which faces toward the outer periphery side of the ink absorbent body 3, and each of the two flow paths 53 corresponds to each of the two sloped surfaces 142 and has the opening 51 in the corresponding sloped surface 142.

However, the two sloped surfaces 142 are on a smoothly continuous convex curved surface having the same curvature, and no ridge-like top portion is formed at the foremost end (tip end) of the joint communicating tube 141. The curvature radius of the continuous two sloped surfaces 142 (see FIG. 11) is for example 3.0 mm.

The other structure of the fourth embodiment is substantially the same as that of the direct liquid type of writing tool according to the third embodiment. In FIGS. 10 and 11, the same parts as those of the third embodiment are shown by the same reference numerals, and detailed explanation thereof is omitted. Respective sizes of the fourth embodiment are substantially the same as those of the first embodiment.

According to the fourth embodiment as well, substantially the same effects as those of the third embodiment can be achieved. That is, the ink absorbent body 3 is pressed not too much in the vicinity of the tip end region 143 of the joint communicating tube 141, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the outer diameter of the joint communicating tube 141 are made smaller, the ink absorbent body 3 is properly pressed in the vicinity of the tip end region 143 of the joint communicating tube 141, so that a proper (desired) high-density portion 31 can be formed in the ink absorbent body 3 in the vicinity of the tip end region 143 of the joint communicating tube 141. As a result, replacement of the ink and air can be smoothly conducted via the respective flow paths 53, so that the ink discharging performance from the pen tip 2 is not deteriorated.

[Fifth Embodiment: Conical Surface]

As a shape of the front end of the joint communicating tube, adoptable is any shape of a rotating body rotationally symmetric around an axis. Such an embodiment is shown in FIGS. 12 and 13 as a fifth embodiment.

Figure 12:
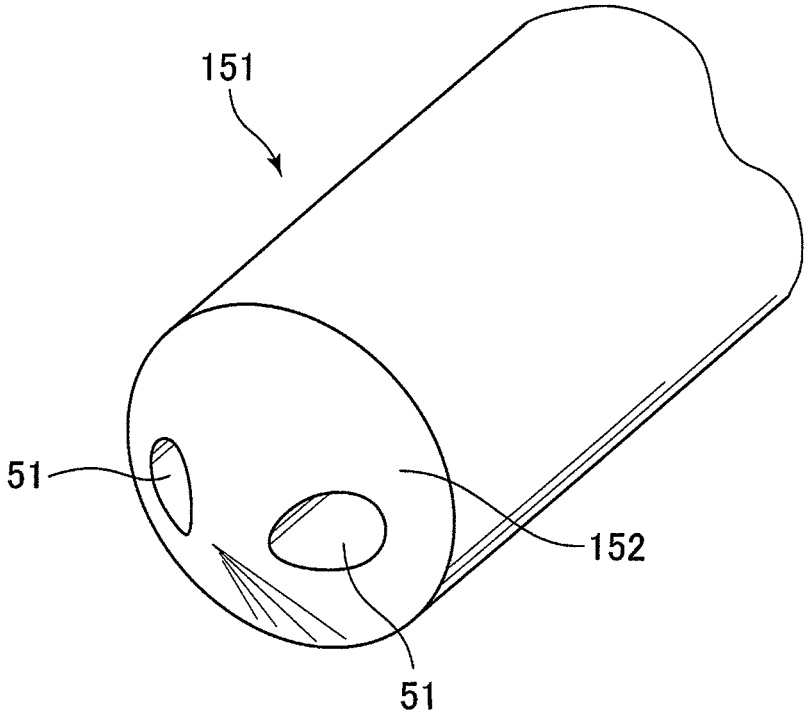
FIG. 12 is a perspective view of a front end of a joint communicating tube of a direct liquid type of writing tool according to a fifth embodiment of the present invention.

FIG. 12 is a perspective view of a front end of a joint communicating tube 151 of a direct liquid type of writing tool according to the fifth embodiment of the present invention. FIG. 13 is a longitudinal section view of the front end of the joint communicating tube 151 shown in FIG. 12. The fifth embodiment corresponds to the first to third and sixth aspects of the present invention.

Figure 13:
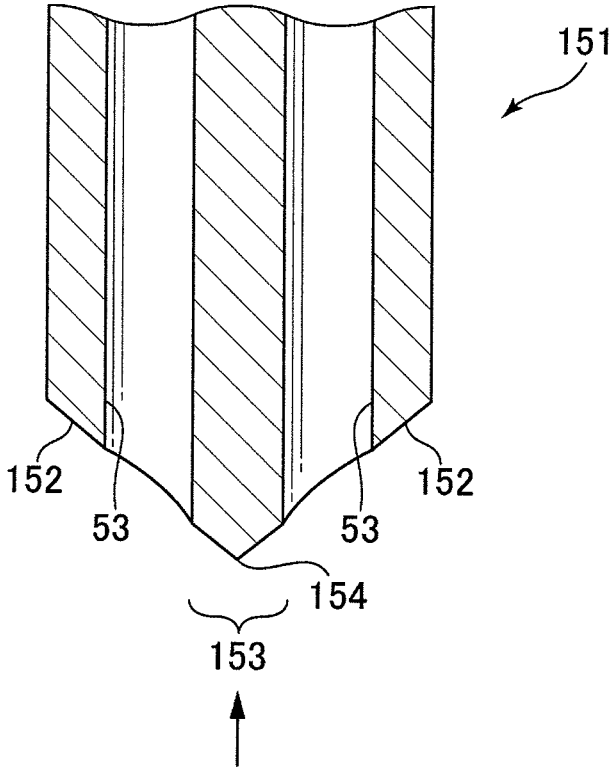
FIG. 13 is a longitudinal section view of the front end of the joint communicating tube shown in FIG. 12.

As shown in FIGS. 12 and 13, the front end of the joint communicating tube 151 is located in the ink absorbent body 3, and has such a configuration that each of the flow paths 53 has an opening 51 in a sloped surface 152 facing toward an outer periphery side of the ink absorbent body 3. In addition, the joint communicating tube 151 has a tip end region 153 adjacent to the respective openings 51 and extending more frontward than the respective openings 51. The tip end region 153 forms a pressing part configured to press inside of the ink absorbent body 3 when the joint communicating tube 151 is inserted frontward from a rear end of the ink absorbent body 3.

Then, as shown in FIGS. 12 and 13, in the direct liquid type of writing tool according to the fifth embodiment, the front end of the joint communicating tube 151 is configured to have a conical sloped surface 152, two flow paths 53 are arranged in pair on diametrically opposite sides in cross section, and each flow path 53 has the opening 51 in the conical sloped surface 152. In the conical shape of the fifth embodiment, as shown in FIG. 13, an angle formed by the conical genetratrixes in a section including the top point 154 is about 90 degrees.

As a supplemental explanation regarding the other sizes of the present embodiment, the diameter of the ink absorbent body 3 is about 5 to 13 mm, the outer diameter D of the joint communicating tube 151 is about 3.0 to 9.0 mm, each flow path 53 has a circle shape in transverse section and the diameter d thereof is about 0.5 to 3.0 mm, and the distance a between the top point 154 and the rear end of the pen tip 2 (see FIG. 1) is about 1.0 to 10 mm. In addition, the separation distance G of the two flow paths 53 is γ mm. That is, at least the rectangular region of γ mm×γ mm when viewed from the front (when viewed in the arrow direction in FIG. 13) achieves the pressing function effectively between the two openings 51. In the present embodiment, the separation distance G between the two flow paths 53 may be selected from a range of 0.5 mm to 4.0 mm, for example.

The other structure of the fifth embodiment is substantially the same as that of the direct liquid type of writing tool according to the third embodiment. In FIGS. 12 and 13, the same parts as those of the third embodiment are shown by the same reference numerals, and detailed explanation thereof is omitted.

According to the fifth embodiment as well, substantially the same effects as those of the third embodiment can be achieved. That is, the ink absorbent body 3 is pressed not too much in the vicinity of the tip end region 153 of the joint communicating tube 151, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the outer diameter of the joint communicating tube 151 are made smaller, the ink absorbent body 3 is properly pressed in the vicinity of the tip end region 153 of the joint communicating tube 151, so that a proper (desired) high-density portion 31 can be formed in the ink absorbent body 3 in the vicinity of the tip end region 153 of the joint communicating tube 151. As a result, replacement of the ink and air can be smoothly conducted via the respective flow paths 53, so that the ink discharging performance from the pen tip 2 is not deteriorated.

In the present embodiment, the top point 154 is formed at the foremost end (tip end) of the joint communicating tube 151. However, adoptable are any manner in which the top point is rounded and the vicinity of the foremost end (tip end) is a part of a spherical surface, and any manner in which the front end of the joint communicating tube 151 has a frustoconical shape.

[Sixth Embodiment: Spherical Surface]

As a shape of the front end of the joint communicating tube, a part of a spherical surface is adoptable. A part of a spherical surface is also a shape of a rotating body rotationally symmetric around an axis. Such an embodiment is shown in FIGS. 14 and 15 as a sixth embodiment.

Figure 14:
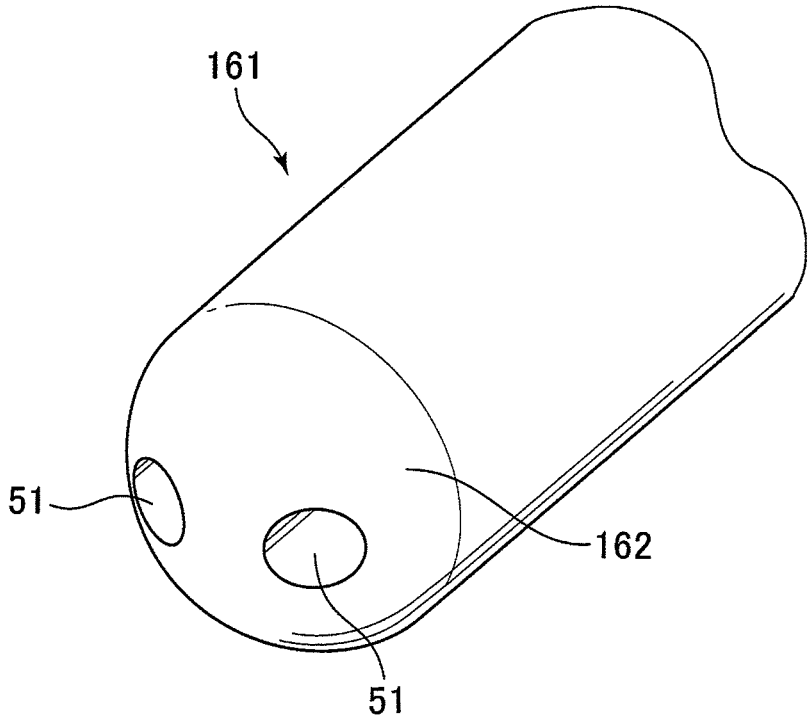
FIG. 14 is a perspective view of a front end of a joint communicating tube of a direct liquid type of writing tool according to a sixth embodiment of the present invention.

FIG. 14 is a perspective view of a front end of a joint communicating tube 161 of a direct liquid type of writing tool according to the sixth embodiment of the present invention. FIG. 15 is a longitudinal section view of the front end of the joint communicating tube 161 shown in FIG. 14. The sixth embodiment corresponds to the first to third and sixth aspects of the present invention.

Figure 15:
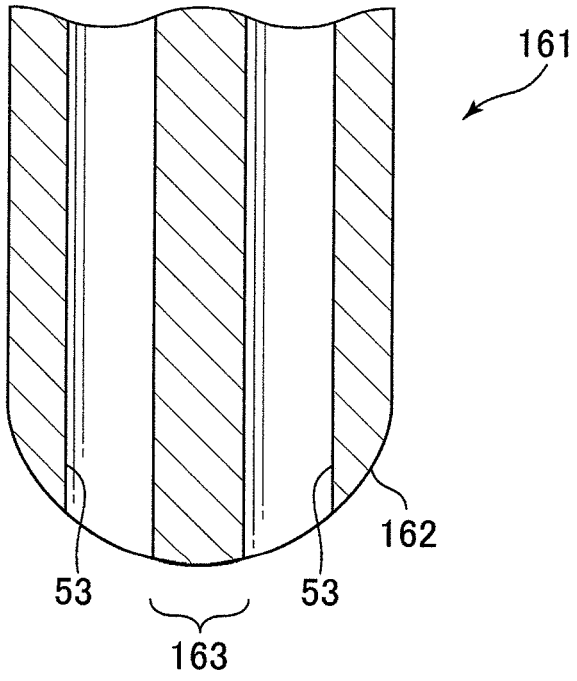
FIG. 15 is a longitudinal section view of the front end of the joint communicating tube shown in FIG. 14.
Figure 16:
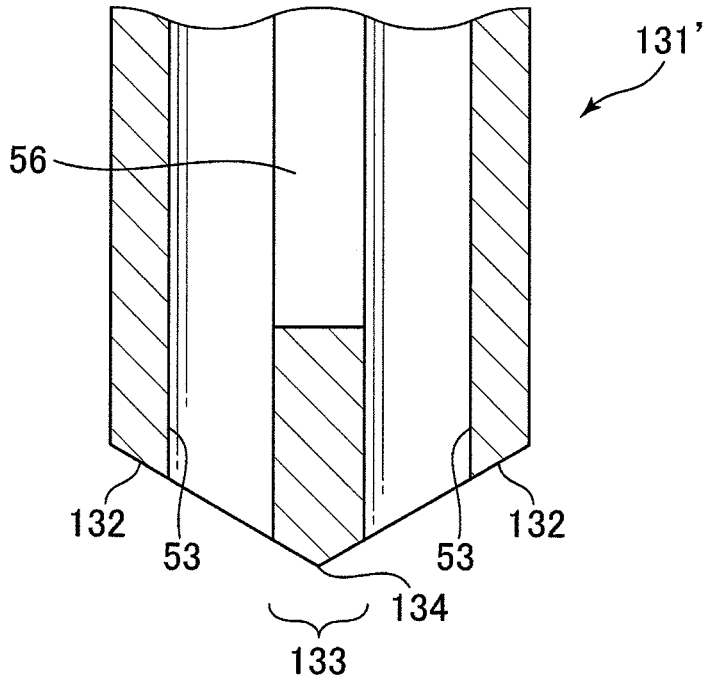
FIG. 16 is a longitudinal section view of a front end of a variation of the joint communicating tube shown in FIGS. 8 and 9.
Figure 17:
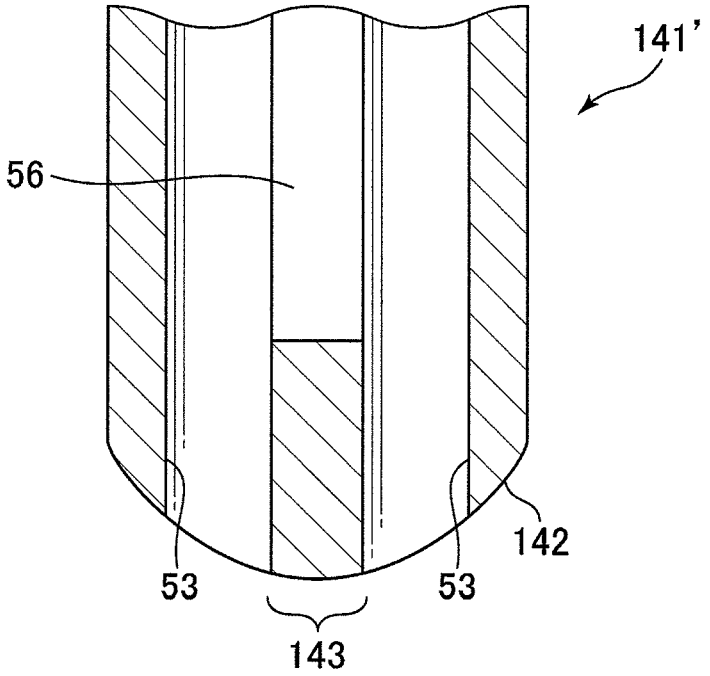
FIG. 17 is a longitudinal section view of a front end of a variation of the joint communicating tube shown in FIGS. 10 and 11.
Figure 18:
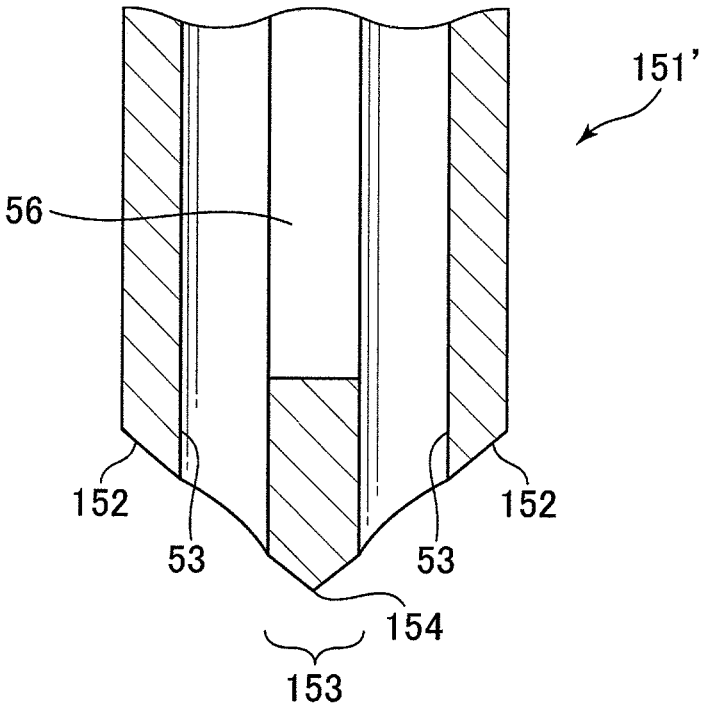
FIG. 18 is a longitudinal section view of a front end of a variation of the joint communicating tube shown in FIGS. 12 and 13.
Figure 19:
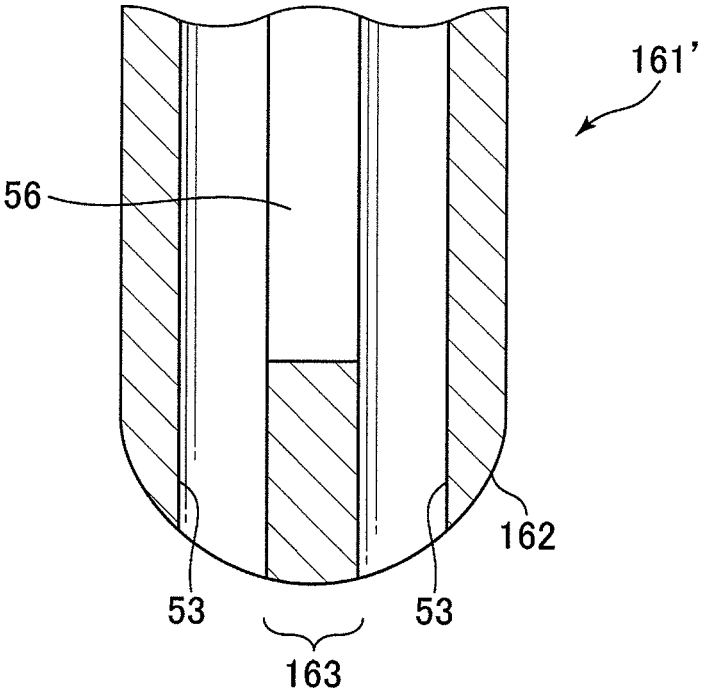
FIG. 19 is a longitudinal section view of a front end of a variation of the joint communicating tube shown in FIGS. 14 and 15.
Figure 20:
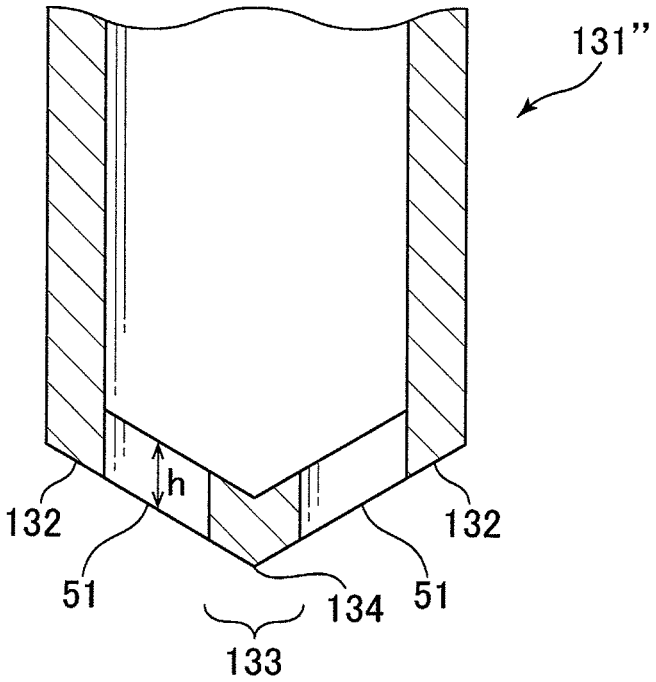
FIG. 20 is a longitudinal section view of a front end of a further variation of the joint communicating tubes shown in FIGS. 8, 9 and 16.
Figure 21:
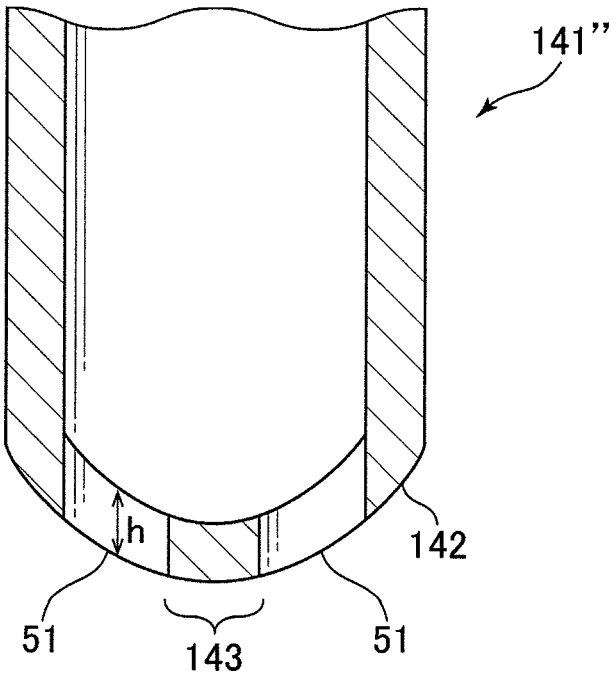
FIG. 21 is a longitudinal section view of a front end of a further variation of the joint communicating tubes shown in FIGS. 10, 11 and 17.
Figure 22:
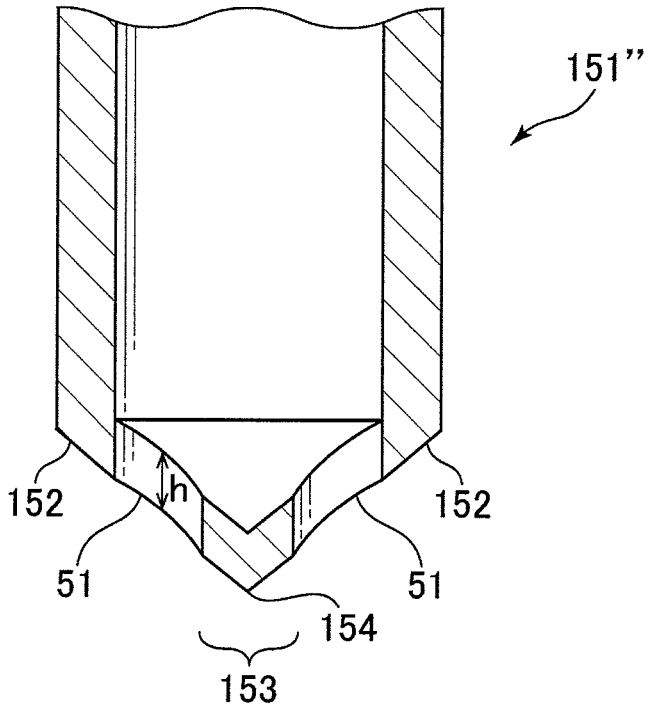
FIG. 22 is a longitudinal section view of a front end of a further variation of the joint communicating tubes shown in FIGS. 12, 13 and 18.
Figure 23:
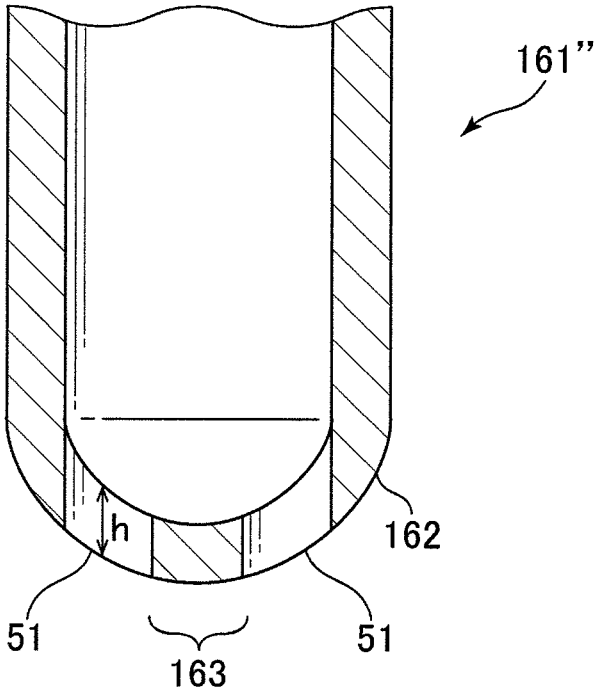
FIG. 23 is a longitudinal section view of a front end of a further variation of the joint communicating tubes shown in FIGS. 14, 15 and 19.

As shown in FIGS. 14 and 15, the front end of the joint communicating tube 161 is located in the ink absorbent body 3, and has such a configuration that each of the flow paths 53 has an opening 51 in a sloped surface 162 facing toward an outer periphery side of the ink absorbent body 3. In addition, the joint communicating tube 161 has a tip end region 163 adjacent to the respective openings 51 and extending more frontward than the respective openings 51. The tip end region 163 forms a pressing part configured to press inside of the ink absorbent body 3 when the joint communicating tube 161 is inserted frontward from a rear end of the ink absorbent body 3.

Then, as shown in FIGS. 14 and 15, in the direct liquid type of writing tool according to the sixth embodiment, the front end of the joint communicating tube 161 is configured to have a partial spherical sloped surface 162, two flow paths 53 are arranged in pair on diametrically opposite sides in cross section, and each flow path 53 has the opening 51 in the partial spherical sloped surface 162. The curvature radius of the partial spherical shape of the sixth embodiment (see FIG. 15) is for example 3.0 mm.

The other structure of the sixth embodiment is substantially the same as that of the direct liquid type of writing tool according to the fifth embodiment. In FIGS. 14 and 15, the same parts as those of the fifth embodiment are shown by the same reference numerals, and detailed explanation thereof is omitted. Respective sizes of the sixth embodiment are substantially the same as those of the fifth embodiment.

According to the sixth embodiment as well, substantially the same effects as those of the fifth embodiment can be achieved. That is, the ink absorbent body 3 is pressed not too much in the vicinity of the tip end region 163 of the joint communicating tube 161, so that sufficient ink discharging performance from the pen tip 2 can be obtained. In particular, even if the outer diameter of the barrel 8 is made smaller to make the barrel 8 thinner, and thus even if the outer diameter of the ink absorbent body 3 and the outer diameter of the joint communicating tube 161 are made smaller, the ink absorbent body 3 is properly pressed in the vicinity of the tip end region 163 of the joint communicating tube 161, so that a proper (desired) high-density portion 31 can be formed in the ink absorbent body 3 in the vicinity of the tip end region 163 of the joint communicating tube 161. As a result, replacement of the ink and air can be smoothly conducted via the respective flow paths 53, so that the ink discharging performance from the pen tip 2 is not deteriorated.

In the present embodiment, the sloped surface 162 at the front end of the joint communicating tube 161 is a partial spherical surface having the uniform curvature radius, but the curvature radius may be different between in an area including the axil center and in another peripheral area (in some cases, and one or more additional intermediate areas).

[Variations]

In the direct liquid type of writing tool according to each of the above embodiments, the flow paths 53 may be communicated with each other in the middle thereof, which is also adoptable as an embodiment of the present invention. For example, regarding the direct liquid type of writing tools according to the third to sixth embodiments, variations are shown in FIGS. 16 to 19, in which the two flow paths 53 are communicated with each other via a communicating path 56. FIGS. 16 to 19 are longitudinal section views of the front ends of the respective variations of the joint communicating tube 131' to 161'.

In extreme cases, although the number of openings is two, the two flow paths 53 may be integral in the whole area other than the openings. Regarding these cases, it can be said that the number of communicating tube is one. Such variations are shown in FIGS. 20 to 23. FIGS. 20 to 23 are longitudinal section views of the front ends of the respective variations of the joint communicating tube 131" to 161".

Each variation of the direct liquid type of writing tool comprises: a pen tip 2; a columnar ink absorbent body 3 connected to a rear end of the pen tip 2; an ink tank 4 arranged on a rear side of the ink absorbent body 3; and a communicating tube 131" to 161" for connecting the ink absorbent body 3 and the ink tank 4; wherein a front end of the communicating tube 131" to 161" is located in the ink absorbent body 3, and has such a configuration that each of two openings 51 is opened in a sloped surface 132 to 162 facing toward an outer periphery side of the ink absorbent body 3, the communicating tube 131" to 161" has a tip end region 133 to 163 adjacent to the respective openings 51 and extending more frontward than the respective openings 51, and the tip end region 133 to 163 forms a pressing part configured to press inside of the ink absorbent body 3 when the communicating tube 131" to 161" is inserted frontward from a rear end of the ink absorbent body 3.

Herein, in order to smoothly conduct the replacement of the ink and the air, the height h of the wall defining each opening 51 is at least 0.5 mm, preferably 1.5 mm.

EXPLANATION OF SIGN

1 direct liquid type of writing tool
2 pen tip
3 ink absorbent body
31 high-density portion
32 low-density portion

4 ink tank
41 main body
41*a* male threaded portion
41*b* flange portion
42 tubular front part
43 plug
5 communicating tube
51 front-end opening
52 sloped surface
52*d* tip end region
53 flow path
56 communicating path
6 connecting part
61 sloped surface
61*d* front-end region
62 ridge-like top portion
7 intermediate member
71 partition
72 connecting tube
73 fitting tubular par
74 stick part
8 barrel
81 female threaded portion
9 ink
12 direct liquid type of writing tool (separation type)
121 slit-like gap
131 joint communicating tube
132 sloped surface (intersecting type)
133 tip end region
134 ridge-like top portion
141 joint communicating tube
142 sloped surface (continuous convex curved surface)
143 tip end region
151 joint communicating tube
152 sloped surface (conical surface)
153 tip end region
154 top point
161 joint communicating tube
162 sloped surface (partial spherical surface)
163 tip end region
131' to 161' variations of joint communicating tube
131" to 161" variations of communicating tube

What is claimed is:

1. A direct liquid type of writing tool comprising:
a pen tip;
a columnar ink absorbent body connected to a rear end of the pen tip;
an ink tank arranged on a rear side of the ink absorbent body; and
a plurality of communicating tubes for connecting the ink absorbent body and the ink tank;
wherein
a front end of each of the communicating tubes is located in the ink absorbent body, and is configured to have a sloped surface facing toward an outer periphery side of the columnar ink absorbent body,
each of the communicating tubes has an opening in the sloped surface at the front end,
each of the communicating tubes has a tip end region adjacent to the opening and extending more frontward than the opening, and
the tip end region forms a pressing part configured to press inside of the ink absorbent body when each of the communicating tubes is inserted frontward from a rear end of the ink absorbent body, wherein said sloped surface faces away from an axial center of the columnar ink absorbent body.

2. The direct liquid type of writing tool according to claim 1, wherein
respective lateral walls of the communicating tubes are connected by a connecting part.

3. The direct liquid type of writing tool according to claim 2, wherein
a front-end region of the connecting part extends more frontward than the opening of each of the communicating tubes so as to form the pressing part together with the tip end region of each of the communicating tubes.

4. The direct liquid type of writing tool according to claim 2, wherein
the front-end region of the connecting part has one or more connecting-part sloped surfaces continuous from the sloped surface of each of the communicating tubes.

5. The direct liquid type of writing tool according to claim 1, wherein
the number of the communicating tubes is two.

6. The direct liquid type of writing tool according to claim 1, wherein
the sloped surface is planar.

7. The direct liquid type of writing tool according to claim 1, wherein
the sloped surface is convexly curved.

8. A direct liquid type of writing tool comprising:
a pen tip;
a columnar ink absorbent body connected to a rear end of the pen tip;
an ink tank arranged on a rear side of the ink absorbent body; and
a joint communicating tube having a plurality of flow paths for connecting the ink absorbent body and the ink tank;
wherein
the pen tip is aligned with an axial center of the ink absorbent body,
a front end of the joint communicating tube is located in the ink absorbent body, and has such a configuration that each of the flow paths has an opening in a sloped surface facing toward an outer periphery side of the ink absorbent body,
the joint communicating tube has a tip end region adjacent to the openings and extending more frontward than the openings, and
the tip end region is also aligned with the axial center of the ink absorbent body, has no opening aligned with the axial center of the ink absorbent body, and forms a pressing part configured to press inside of the ink absorbent body when the joint communicating tube is inserted frontward from a rear end of the ink absorbent body.

9. The direct liquid type of writing tool according to claim 8, wherein
the front end of the joint communicating tube is configured to have a plurality of sloped surfaces, each of which faces toward the outer periphery side of the ink absorbent body, and
each of the flow paths corresponds to each of the plurality of sloped surfaces, and has the opening in the corresponding sloped surface.

10. The direct liquid type of writing tool according to claim 9, wherein
the number of the flow paths is two.

11. The direct liquid type of writing tool according to claim 9, wherein
each of the plurality of sloped surfaces is planar.

12. The direct liquid type of writing tool according to claim 9, wherein each of the plurality of sloped surfaces is convexly curved.

13. The direct liquid type of writing tool according to claim 8, wherein the front end of the joint communicating tube has the shape of a rotating body rotationally symmetric around an axis.

14. The direct liquid type of writing tool according to claim 13, wherein the front end of the joint communicating tube has the shape of a conical or frustoconical body.

15. The direct liquid type of writing tool according to claim 13, wherein the front end of the joint communicating tube has the shape of a part of a spherical body.

16. A direct liquid type of writing tool comprising:

a pen tip;

a columnar ink absorbent body connected to a rear end of the pen tip;

an ink tank arranged on a rear side of the ink absorbent body; and a communicating tube for connecting the ink absorbent body and the ink tank;

wherein the pen tip is aligned with an axial center of the ink absorbent body, a front end of the communicating tube is located in the ink absorbent body, and has such a configuration that each of a plurality of openings is opened in a sloped surface facing toward an outer periphery side of the ink absorbent body, the communicating tube has a tip end region adjacent to the openings and extending more frontward than the openings, and the tip end region is also aligned with the axial center of the ink absorbent body, has no opening aligned with the axial center of the ink absorbent body, and forms a pressing part configured to press inside of the ink absorbent body when the communicating tube is inserted frontward from a rear end of the ink absorbent body.

17. The direct liquid type of writing tool according to claim 16, wherein the front end of the communicating tube is configured to have a plurality of sloped surfaces, each of which faces toward the outer periphery side of the ink absorbent body, and each of the plurality of openings corresponds to each of the plurality of sloped surfaces, and is opened in the corresponding sloped surface.

18. The direct liquid type of writing tool according to claim 17, wherein the number of the openings is two.

19. The direct liquid type of writing tool according to claim 17, wherein each of the plurality of sloped surfaces is planar.

20. The direct liquid type of writing tool according to claim 17, wherein each of the plurality of sloped surfaces is convexly curved.

21. The direct liquid type of writing tool according to claim 16, wherein the front end of the communicating tube has the shape of a rotating body rotationally symmetric around an axis.

22. The direct liquid type of writing tool according to claim 21, wherein the front end of the communicating tube has the shape of a conical or frustoconical body.

23. The direct liquid type of writing tool according to claim 21, wherein the front end of the communicating tube has the shape of a part of a spherical body.

* * * * *